US005937468A

United States Patent [19]

Wiedeck et al.

[11] Patent Number: 5,937,468

[45] Date of Patent: Aug. 17, 1999

[54] SYSTEM FOR LAYING A PORTABLE BRIDGE

[75] Inventors: Hans-Norbert Wiedeck, Mühlheim; Wolfgang Diefendahl, Straelen, both of Germany

[73] Assignee: Man Technologie AG, Augsburg, Germany

[21] Appl. No.: 08/993,854

[22] Filed: Dec. 18, 1997

[30] Foreign Application Priority Data

Jan. 18, 1997 [DE] Germany ..... 197 01 650

[51] Int. Cl.[6] ..... E01D 15/14

[52] U.S. Cl. ..... 14/2.5; 14/2.4

[58] Field of Search ..... 14/2.4, 2.5, 77.1, 14/1

[56] References Cited

U.S. PATENT DOCUMENTS

| | | | |
|---|---|---|---|
| 3,820,181 | 6/1974 | Wagner et al. | 14/1 |
| 4,510,637 | 4/1985 | Zlotnicki | 14/2.4 |
| 5,276,930 | 1/1994 | Parramore | 14/2.5 |
| 5,553,341 | 9/1996 | Wiedeck | 14/2.4 |
| 5,570,486 | 11/1996 | Wiedeck | 14/14 |

FOREIGN PATENT DOCUMENTS

| | | | |
|---|---|---|---|
| 0 523 757 | 1/1993 | European Pat. Off. . | |
| 362063 | 4/1990 | France | 14/2.5 |
| 2403494 | 8/1975 | Germany . | |
| 41 27 106 | 2/1993 | Germany . | |
| 2258678 | 2/1993 | United Kingdom . | |

*Primary Examiner*—Thomas B. Will
*Assistant Examiner*—Raymond Addie
*Attorney, Agent, or Firm*—Herbert Dubno; Andrew Wilford

[57] ABSTRACT

A bridge-laying apparatus has a vehicle adapted to travel in a longitudinal direction and a longitudinally extending laying arm adapted to lay down and pick up bridges formed of at least one bridge section. A rigid link has an upper end pivoted on the laying arm and a lower end pivoted directly on the vehicle and an expansible main cylinder offset horizontally from the link has an upper end pivoted on the arm and a lower end pivoted directly on the vehicle. A pusher cylinder extending nonparallel to the main cylinder has a lower end pivoted on the vehicle and an upper end pivoted on the arm.

9 Claims, 4 Drawing Sheets

SYSTEM FOR LAYING A PORTABLE BRIDGE

FIELD OF THE INVENTION

The present invention relates to a portable bridge formed by one or more bridge sections. More particularly this invention concerns a method of and apparatus for laying such a bridge.

BACKGROUND OF THE INVENTION

A special-duty bridge-laying vehicle is known that is used to transport the bridge sections to the location where the bridge is to be laid, to position the bridge sections as they are assembled together, and to subsequently pull or pick up the bridge so it can be used elsewhere. Such a vehicle, which is typically tracked but which can have standard highway wheels, is provided with a laying arm that serves several functions. First of all it handles and positions the bridge sections, positioning them on the river bank or picking them up off the bank or other declivity that must be bridged. It also holds the bridge sections as they are joined together and allows the assembled bridge to be thrust across the river or other declivity while compensating for uneven ground conditions.

One known bridge-laying apparatus described in German patent document 2,403,494 has a laying arm moved either by a central longitudinally effective hydraulic cylinder or by two right and left-hand parallel-working cylinders. Since the laying arm pivots about an axis on the laying-vehicle frame, with every movement the bridge section being handled is moved longitudinally. This makes it very hard to get the sections aligned with each other for proper assembly while making positioning the finished structure on the terrain also fairly difficult. In addition any movement of the laying arm entails a tipping action that once again makes it difficult to align the various parts.

German published patent application 4,127,106 of Karcher describes another system wherein the laying arm is mounted at the rear end via a lever arm to the vehicle frame and in the transport or starting position its middle part is secured removably on an axis fixed to the vehicle while in the laying position it is mounted via a joint to an extensible leg that stands on the ground. A hydraulic cylinder is linked to the lever arm to lift and lower it simultaneously with the rear end of the laying arm. If either the middle part of the laying arm is resting on the axis fixed to the vehicle frame or the front part on the extensible leg, the laying arm extends at different angles when the hydraulic cylinder raises or lowers the rear end of the arm, thereby complicating the handling of the bridge sections.

OBJECTS OF THE INVENTION

It is therefore an object of the present invention to provide an improved bridge-laying apparatus and method.

Another object is the provision of such an improved bridge-laying apparatus and method which overcomes the above-given disadvantages, that is which is relatively simple and which makes it easy to assemble and lay the sections of a portable bridge.

SUMMARY OF THE INVENTION

A bridge-laying apparatus has according to the invention a vehicle adapted to travel in a longitudinal direction and a longitudinally extending laying arm adapted to lay down and pick up bridges formed by one or more sections. A rigid link has an upper end pivoted on the laying arm and a lower end pivoted directly on the vehicle and an expansible main cylinder offset horizontally from the link has an upper end pivoted on the arm and a lower end pivoted directly on the vehicle. A pusher cylinder extending nonparallel to the main cylinder has a lower end pivoted on the vehicle and an upper end pivoted on the arm.

Thus with this system as the laying arm is moved outward it will remain parallel to the ground and to the bridge sections normally stacked behind it on the vehicle. It does not tip while moving out a bridge section.

According to the invention the arm, link, main cylinder, and vehicle can together form a parallelogrammatic linkage having pivots at the ends of the link and main cylinder. This eliminates the need for a separate lifter to load the bridge sections onto the laying arm. In addition short single-section bridges can be laid very quickly with this system.

In accordance with the invention the upper ends of the link and of the pusher cylinder are pivoted about a common axis on the arm. In this manner it is possible to exactly position the laying arm, even when the terrain is difficult.

The apparatus according to the invention further has means for transferring bridge sections from a position resting atop the vehicle to a position supported on the arm. This transfer means includes at least one pivotal arm.

In addition the apparatus has a support leg pivoted on the vehicle and having a lower end engageable with the ground in front of the vehicle. The support-leg upper end and the link upper end are pivoted on the arm at a common axis. This allows the arm and a bridge section it is carrying to be extended quite a distance ahead of the vehicle.

The method according to the invention comprises the steps of sequentially laying one of the bridge sections on the laying arm, advancing the laying arm with the pusher cylinder to a forwardly advanced laying position, and then extending a support strut hanging from the arm to a forward position and extending the support strut downward to support the arm directly on the ground ahead of the vehicle. Thereafter the main cylinder is extended to pivot down a front end of the arm and the bridge section carried thereby until a front end of the bridge section carried by the arm engages an opposite bank of a declivity in front of the vehicle. Then the support strut is retracted and swung back out of the way so that the main cylinder can be further extended to set a rear end of the bridge section on a near bank of the declivity, normally a river.

According to the invention to form a two-section bridge after transferring the uppermost bridge section to the laying arm and before advancing the laying arm of the length of the pusher cylinder is set by extending or retracting it such that the laying arm is aligned with the next uppermost bridge section. Then the next uppermost bridge section is transferred to the laying arm. For a three-section or more bridge the sections are successively loaded onto the laying arm so the entire bridge formed thereby can be installed in one laying-down operation.

With this method it is possible to install one-section or multi-section bridges in a simple and fast manner. The apparatus can similarly be used to dismantle and/or take up a previously installed portable bridge.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
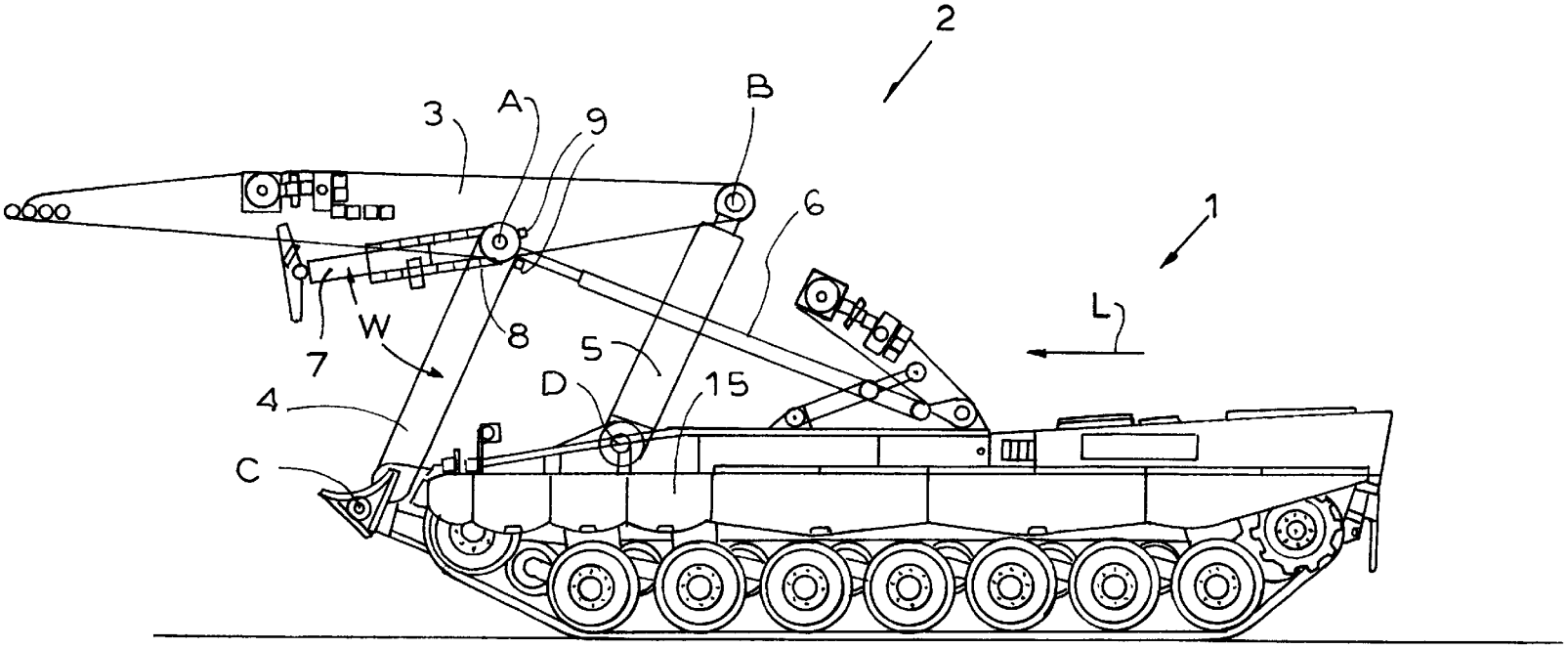
FIG. 1 is a side view of the bridge-laying vehicle according to the invention in the starting or transport position.

As seen in FIG. 1 a vehicle 1 carries a laying apparatus 2 that has a laying arm 3 mounted for movement relative to the vehicle 1. The movable mount is formed by at least one rigid front link 4 and at least one extensible main cylinder or back link 5 that are spaced apart in a longitudinal travel direction L. In fact two such synchronously acting front links 4 and back cylinder/links 5 are provided normally to lift the relatively wide bridge structure, but hereinafter discussion will be of only one of each for simplicity's sake. The upper ends of the links 4 and 5 are pivoted at parallel axes A and B on the arm 3 and the lower ends at respective parallel axes C and D on a frame 15 of the vehicle 1, thereby forming with the arm 3 and vehicle frame 15 a four-sided linkage with the distance between A and B equal to the distance between C and D. When the length of the main cylinder 5 is the same as the length of the link 4 the arm 3, link 4, main cylinder 5, and the vehicle between the axes C and D form a parallelogrammatic linkage.

A pusher or pivot cylinder 6 has a lower end pivoted on the vehicle 1 and an upper end pivoted on the arm 3 at the axis A and serves to raise and lower the arm 3. The arm 3 is provided with a cylinder forming an extensible support leg or strut 7 pivoted at A on the arm 3. A drive 8 allows an angle W between the support leg 7 and the link 4 to be set and abutments 9 on the arm 3 limit the angular travel of this leg 7 about the axis A. It is also within the scope of the invention to provide a tension element (e.g. a chain or cable) of appropriate length connected between the leg 7 offset from the axis A and the link 4 or frame 15 to limit angular movement of the leg 7 because in the laying phase there is a torque that tends to increase the angle W.

Figure 2:
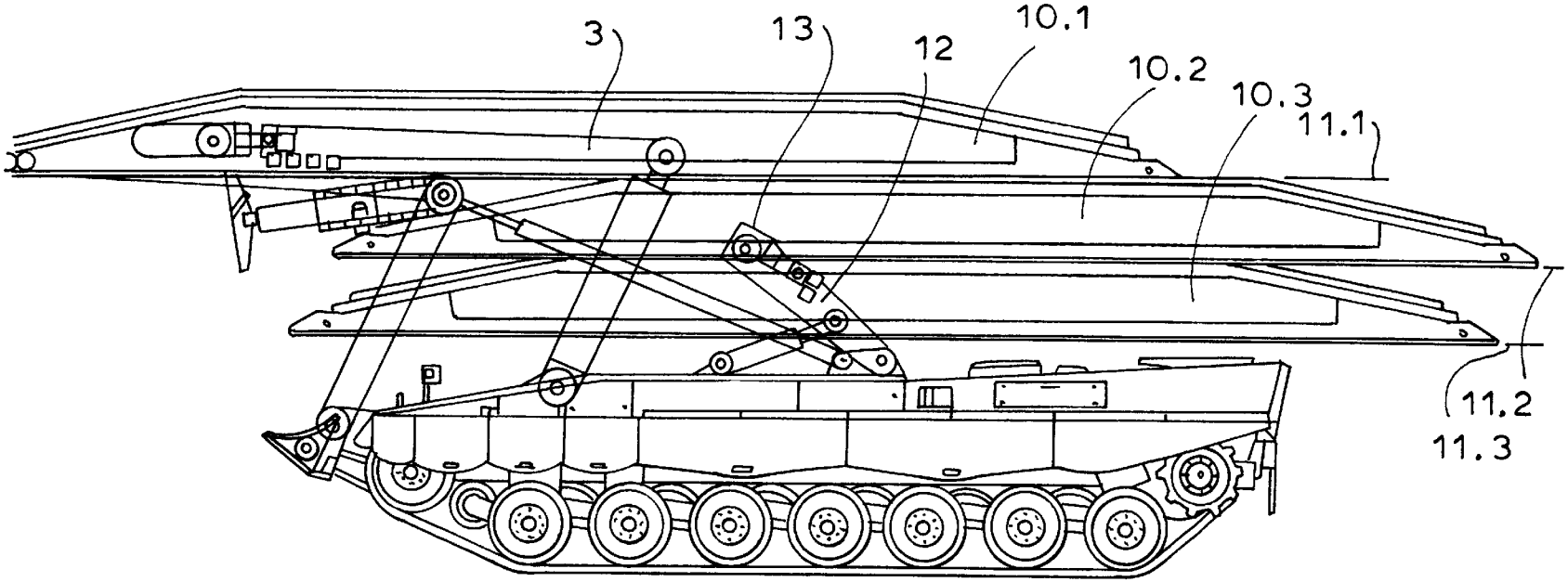
FIG. 2 is the vehicle in the FIG. 1 position and carrying a plurality of bridge sections.

As shown in FIG. 2 bridge sections 10.1, 10.2, and 10.3 are supported on the rear part of the vehicle 1, each lying above a respective horizontal plane 11.1, 11.2, and 11.3. An arm 12 and a section pusher or drive 13 are provided for loading and transferring the sections 10.1–10.3 onto the arm 3, the arm 12 being mounted on the vehicle frame. The section drive 13 is mounted at the end of the arm 12 and is provided with a gear engaging in racks formed in the bridge sections 10.1–10.3 as disclosed in European patent 0,523,757. The arm 12 is pivotally mounted to reach the different planes or levels 11.1–11.3.

Figure 3:
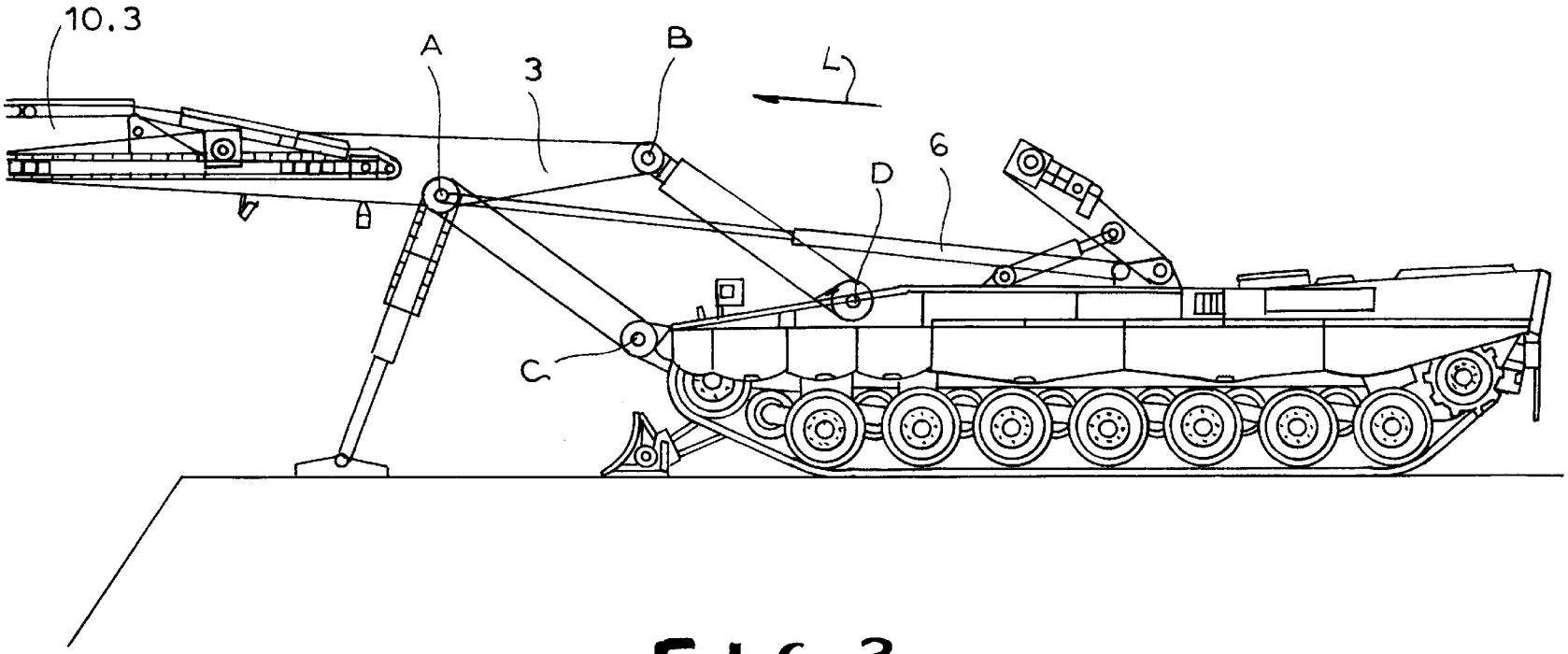
FIG. 3 shows the vehicle and laying apparatus in the laying position.

In order to move the laying arm 3 from the starting or transport position of FIGS. 1 and 2 into the laying position of FIG. 3 the pusher cylinder 6 is extended. This causes the laying arm 3 to make a translatory movement forward and down. Since the axes A, B, C, and D define a parallelogram, the orientation of the arm 3 relative to the horizontal will not change, that is it will not tip when moved forward. This makes it possible to orient the arm 3 level with any of the planes 11.1, 11.2, or 11.3 for transfer of the respective bridge section 10.1, 10.2, or 10.3 to it by the transfer elements (arm 12 and drive 13).

Figure 4:
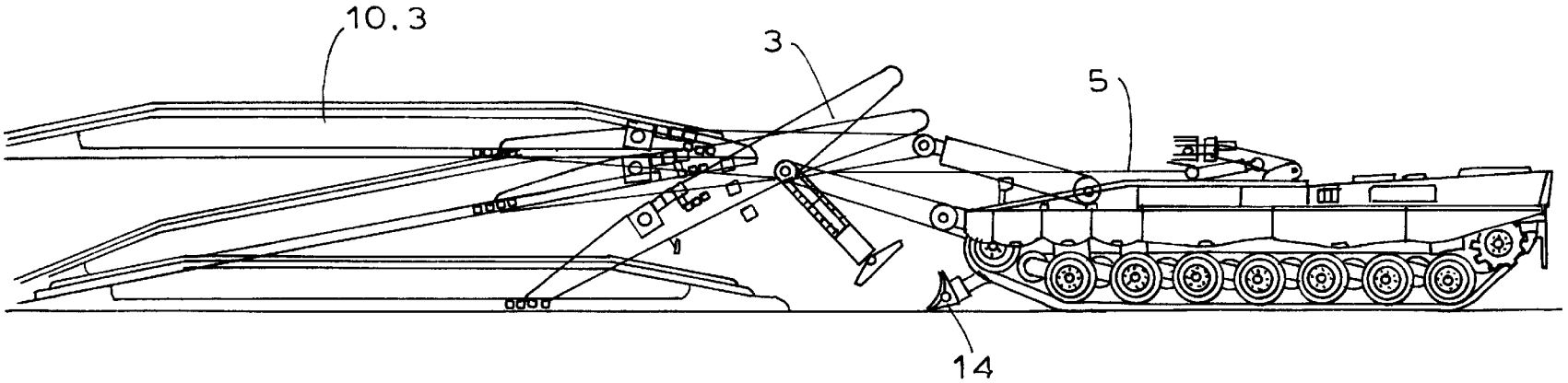
FIG. 4 is the vehicle and the laying apparatus in the end positions as it lays down a bridge section.

FIG. 4 shows how the bridge section 10.3 is laid down. After the arm 3 carrying the bridge section 10.3 has moved as far forward as possible, the rear link 5 is extended to tip it down until its front end touches the ground on the opposite bank of the river and then its rear end comes to rest on the near bank, whereupon the laying arm 3 can be pulled away from the section 10.3. Once the front end of the section 10.3 is engaged with the ground the leg 7 is normally retracted and a support strut 14 is used alone to stabilize the vehicle.

In the case that individual bridge elements 10.1, 10.2, and 10.3 (see FIG. 2) are coupled together as parts of a modular bridge system to be laid in place, the individual planes 11.1, 11.2, and 11.3 are advanced one after the other, the elements 10.1, 10.2, and 10.3 are coupled together, and then extended across to the opposite bank of the river to be bridged. When only a single bridge section, for example the section 10.3 is to be laid in position, as a rule the vehicle is only braced by the strut 14. The leg 7 is necessary when the bridge section or sections must be extended at some distance forward from the vehicle 1.

We claim:

1. A bridge-laying apparatus comprising:

a vehicle adapted to travel in a longitudinal direction;

a longitudinally extending laying arm adapted to lay down and pick up a bridge formed by at least one section;

a rigid link having an upper end pivoted on the laying arm and a lower end pivoted directly on the vehicle;

an expansible main cylinder offset horizontally from the link and having an upper end pivoted on the arm and a lower end pivoted directly on the vehicle; and a pusher cylinder extending nonparallel to the main cylinder and having a lower end pivoted on the vehicle and an upper end pivoted on the arm.

2. The bridge-laying apparatus defined in claim 1 wherein the main cylinder is extensible such that the arm, link, main cylinder, and vehicle together form a parallelogrammatic linkage having pivots at the ends of the link and main cylinder.

3. The bridge-laying apparatus defined in claim 1 wherein the upper ends of the link and of the pusher cylinder are pivoted about a common axis on the arm.

4. The bridge-laying apparatus defined in claim 1, further comprising means for transferring bridge sections from a position resting atop the vehicle to a position supported on the arm.

5. The bridge-laying apparatus defined in claim 4 wherein the transfer means includes at least one pivotal arm.

6. The bridge-laying apparatus defined in claim 1, further comprising a support leg pivoted on the vehicle and having a lower end engageable with the ground in front of the vehicle.

7. The bridge-laying apparatus defined in claim 1 further comprising a support leg pivoted on the arm and having a lower end engageable with the ground in front of the vehicle, wherein the upper end of the support leg and the link upper end are pivoted on the arm at a common axis.

8. A method of operating bridge-laying apparatus having:

a vehicle adapted to travel in a longitudinal direction and capable of carrying a stack of bridge sections lying in respective vertically spaced planes;

a longitudinally extending laying arm adapted to lay down and pick up a bridge formed by at least one of the sections;

a rigid link having an upper end pivoted on the laying arm and a lower end pivoted directly on the vehicle;

an expansible main cylinder offset horizontally from the link and having an upper end pivoted on the arm and a lower end pivoted directly on the vehicle; and a pusher cylinder extending nonparallel to the main cylinder and having a lower end pivoted on the vehicle and an upper end pivoted on the arm, the method comprising the steps of sequentially:

setting a length of the main cylinder such that the arm, link, main cylinder, and vehicle together form a parallelogrammatic linkage;

setting the length of the pusher cylinder such that the arm is aligned with the plane of the uppermost bridge section;

transferring the uppermost bridge section to the laying arm;

advancing the laying arm with the pusher cylinder to a forwardly advanced laying position;

extending a support strut hanging from the arm to a forward position and extending the support strut downward to support the arm directly on the ground ahead of the vehicle;

extending the main cylinder and thereby pivoting down a front end of the arm and the bridge carried thereby until a front end of the bridge section carried by the arm engages an opposite bank of a declivity in front of the vehicle;

retracting the support strut and swinging it back out of the way;

further extending the main cylinder to set a rear end of the bridge on a near bank of the declivity; and disengaging the laying arm from the bridge.

9. The bridge-laying method defined in claim 8, further comprising the steps after transferring the uppermost bridge section to the laying arm and before advancing the laying arm of:

setting the length of the pusher cylinder such that the laying arm is aligned with the next uppermost bridge section; and transferring the next uppermost bridge section to the laying arm.

* * * * *